US009156576B2

(12) United States Patent
Pjanic et al.

(10) Patent No.: US 9,156,576 B2
(45) Date of Patent: Oct. 13, 2015

(54) SAFETY CHAMBER

(75) Inventors: Damir Pjanic, Lund (SE); Gert Lindström, Blentarp (SE); Tomas Lagus, Åkarp (SE); Rune Carlsson, Bjärred (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 942 days.

(21) Appl. No.: 13/262,392

(22) PCT Filed: Dec. 21, 2009

(86) PCT No.: PCT/SE2009/000531

§ 371 (c)(1),
(2), (4) Date: Sep. 30, 2011

(87) PCT Pub. No.: WO2010/114434

PCT Pub. Date: Oct. 7, 2010

(65) Prior Publication Data

US 2012/0036814 A1 Feb. 16, 2012

(30) Foreign Application Priority Data

Apr. 1, 2009 (SE) ..... 0900430

(51) Int. Cl.

| | |
|---|---|
| ***B65B 55/04*** | (2006.01) |
| ***B67B 1/03*** | (2006.01) |
| ***B65B 55/10*** | (2006.01) |
| *B65B 61/18* | (2006.01) |

(52) U.S. Cl.

CPC ..... *B65B 55/103* (2013.01); *B65B 61/186* (2013.01)

(58) Field of Classification Search

CPC ..... B65B 55/103; B65B 61/186
USPC ..... 53/410, 426
See application file for complete search history.

(56) References Cited

U.S. PATENT DOCUMENTS 3,884,012 A * 5/1975 Ernstsson et al. ..... 53/426
3,899,862 A 8/1975 Muys et al.

(Continued)

FOREIGN PATENT DOCUMENTS

BE 895851 A1 8/1983
DE 10 2005 012 507 A1 9/2006

(Continued)

OTHER PUBLICATIONS

*International Search Report (PCT/ISA/210) issued on Aug. 20, 2010, by Swedish Patent Office as the International Searching Authority for International Application No. PCT/SE2009/000531.

*Primary Examiner* — Robert Long
(74) *Attorney, Agent, or Firm* — Buchanan Ingersoll & Rooney PC

(57) ABSTRACT

An arrangement is provided to prevent emissions of hydrogen peroxide from a packaging machine forming sealed packaging containers from a packaging material web. The packaging machine has a sterilization portion comprising an inlet chamber, a peroxide bath and an aseptic chamber. The aseptic chamber is held at an overpressure while the inlet chamber is held at an underpressure during normal operation of the packaging machine. The peroxide bath functions as a seal between the inlet chamber and the aseptic chamber. A safety chamber placed in front of the inlet chamber is held at an underpressure to avoid peroxide emissions to the environment. The packaging material web will pass the safety chamber before going into the inlet chamber.

11 Claims, 2 Drawing Sheets

(56) References Cited

U.S. PATENT DOCUMENTS

| | | | | | |
|---|---|---|---|---|---|
| 3,904,361 | A * | 9/1975 | Egger | 422/27 |
| 3,911,640 | A * | 10/1975 | Rausing | 53/426 |
| 4,225,556 | A * | 9/1980 | Lothman et al. | 422/28 |
| 4,495,016 | A * | 1/1985 | Viberg et al. | 156/152 |
| 4,641,486 | A * | 2/1987 | Zannoni | 53/433 |
| 4,707,334 | A | 11/1987 | Gerhard | |
| 4,969,998 | A * | 11/1990 | Henn | 210/490 |
| 5,008,076 | A * | 4/1991 | Johansson et al. | 422/28 |
| 5,011,664 | A * | 4/1991 | Olanders | 422/292 |
| 5,044,140 | A * | 9/1991 | Iwano et al. | 53/167 |
| 5,129,999 | A * | 7/1992 | Holland et al. | 205/701 |
| 5,424,034 | A * | 6/1995 | Hilmersson | 422/28 |
| 5,431,939 | A * | 7/1995 | Cox et al. | 426/300 |
| 5,672,374 | A * | 9/1997 | McCabe | 426/635 |
| 5,947,318 | A * | 9/1999 | Palm | 220/278 |
| 5,972,292 | A * | 10/1999 | DeMeo | 422/25 |
| 6,622,457 | B2 * | 9/2003 | Kurth | 53/425 |
| 6,666,002 | B1 * | 12/2003 | Otsuka et al. | 53/426 |
| 6,810,644 | B2 * | 11/2004 | Palm | 53/450 |
| 6,885,011 | B2 * | 4/2005 | Koenck et al. | 250/455.11 |
| 7,003,934 | B1 * | 2/2006 | Yano | 53/552 |
| 7,007,441 | B2 * | 3/2006 | Benedetti et al. | 53/167 |
| 7,093,405 | B2 * | 8/2006 | Andersson et al. | 53/167 |
| 7,154,103 | B2 * | 12/2006 | Koenck et al. | 250/455.11 |
| 7,205,016 | B2 * | 4/2007 | Garwood | 426/108 |
| 7,415,428 | B2 * | 8/2008 | Garwood | 705/26.5 |
| 8,658,085 | B2 * | 2/2014 | Kristiansson et al. | 422/22 |
| 2001/0035500 | A1 * | 11/2001 | Schianchi et al. | 250/455.11 |
| 2001/0053402 | A1 * | 12/2001 | Orii et al. | 426/399 |
| 2003/0185948 | A1 * | 10/2003 | Garwood | 426/392 |
| 2004/0011004 | A1 * | 1/2004 | Kurth | 53/426 |
| 2004/0086421 | A1 * | 5/2004 | Moller et al. | 422/22 |
| 2005/0076612 | A1 * | 4/2005 | Andersson et al. | 53/167 |
| 2005/0126117 | A1 * | 6/2005 | Benedetti et al. | 53/167 |
| 2006/0150343 | A1 * | 7/2006 | Christ | 8/149.1 |
| 2009/0071104 | A1 | 3/2009 | Fischer | |
| 2009/0208369 | A1 * | 8/2009 | Olsson et al. | 422/28 |
| 2009/0282784 | A1 * | 11/2009 | Ferrarini et al. | 53/426 |
| 2011/0146205 | A1 * | 6/2011 | Caudle et al. | 53/410 |
| 2014/0196407 | A1 * | 7/2014 | Ghirardello et al. | 53/426 |

FOREIGN PATENT DOCUMENTS

| | | | |
|---|---|---|---|
| EP | 1 245 493 | A1 | 10/2002 |
| WO | WO 82/03832 | A1 | 11/1982 |
| WO | WO 98/12112 | A1 | 3/1998 |
| WO | WO 2005/120960 | A1 | 12/2005 |

* cited by examiner

SAFETY CHAMBER

TECHNICAL FIELD

The present invention concerns a safety chamber to be used in a packing machine in which sealed packaging containers or carton packages are formed from a packing material web.

PRIOR ART

Before the packaging containers are formed and filled the packaging material web passes a sterilization part. In the sterilization part the packaging material web first enters an inlet chamber, passes a sterilization bath, containing hydrogen peroxide. After the sterilization or peroxide bath the packaging material web goes into an aseptic chamber. In the aseptic chamber there is an overpressure to assure a sterile environment, while there is an underpressure in the inlet chamber above the peroxide bath. The peroxide bath acts as a liquid seal between the aseptic chamber and the inlet chamber of the peroxide bath. The underpressure in the inlet chamber reduces the risk of peroxide emissions to the environment.

When the packing machine is in production there is sometimes a need for shorter or longer stops, either planned stops or stops due to some malfunction. During stops the peroxide bath is drained and, thus, there will be no seal between the aseptic chamber and the inlet chamber. Due to the different pressures there might possibly, in some occasions in different machine steps, be a risk of hydrogen peroxide emissions.

SUMMARY OF THE INVENTION

One aim of the present invention is to further secure that any risk of hydrogen peroxide emissions from the sterilization part of the packing machine is avoided, during any stops in the production.

The present invention is intended for packaging machine forming sealed packaging containers from a packaging material web. The packaging material web is led through a sterilization portion comprising an inlet chamber, a peroxide bath and an aseptic chamber. The packaging material web is led from the inlet chamber through the peroxide bath and then into the aseptic chamber. In the inlet for the packaging material web into the inlet chamber a lip seal is arranged. In production the aseptic chamber is held at an overpressure while the inlet chamber is held at an underpressure. According to the invention a safety chamber is placed in front of the inlet to the inlet chamber, whereby the packaging material web passes the safety chamber before going into the inlet chamber.

Further objects and advantages of the present invention will be obvious to a person skilled in the art reading the detailed description below of one embodiment of the invention.

BRIEF DESCRIPTION OF THE DRAWINGS

The invention will be described more closely below in way of an example and with reference to the enclosed drawings. In the drawings.

DETAILED DESCRIPTION OF EMBODIMENTS OF THE INVENTION

Figure 1:
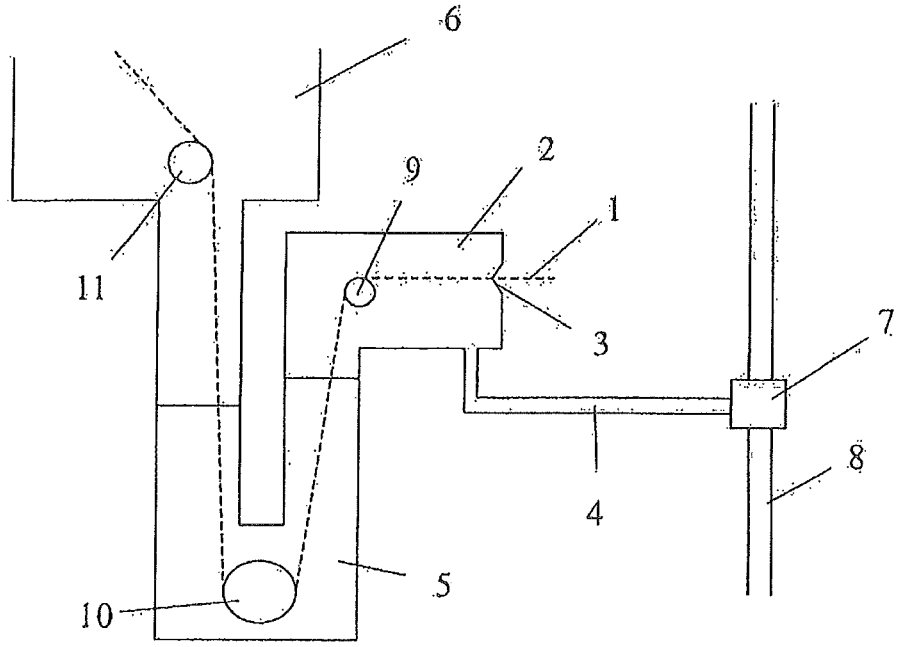
FIG. 1 is a schematic view of a portion of the sterilization part of a packaging machine according to prior art.

As shown in FIG. 1 a packaging material web 1 is introduced into an inlet chamber 2 through an opening having a lip seal 3. From the inlet chamber 2 the packaging material web 1 goes down into a peroxide bath 5. After the peroxide bath 5 the packaging material web 1 goes into an aseptic chamber 6. In the shown embodiment the packaging material web 1 is lead over a number of guide rolls 9, 10, 11. As used in this description the expression "peroxide bath" is to be construed as a bath comprising hydrogen peroxide.

To eliminate any risk of hydrogen peroxide emissions to the environment outside the packaging machine the inlet chamber 2 is held at a constant underpressure in production. Also the lip seal 3 of the inlet chamber 2 assists in securing elimination of any risk of peroxide emissions. A suction pipe 4 connects by means of a valve 8 the inlet chamber 2 with a main suction pipe 7. In the aseptic chamber 6 there is an overpressure during production.

Figure 2:
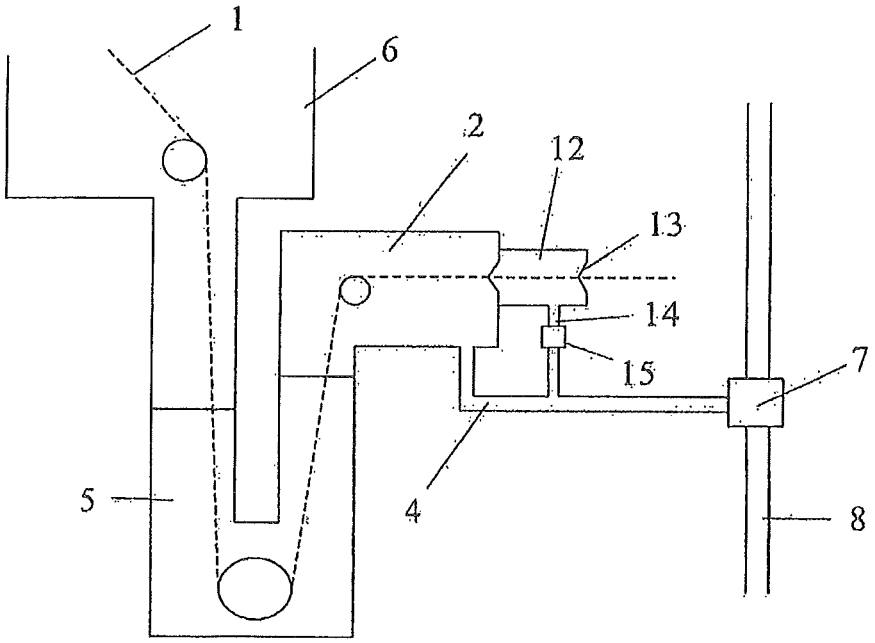
FIG. 2 is a schematic view of a part of FIG. 1 with an added safety chamber according to the present invention.

The peroxide bath 5 will in practice form a seal between the inlet chamber 2 held at underpressure and the aseptic chamber 6 held at overpressure. During short stops, due to some unforeseen event, and normal scheduled stops in the packaging machine, the peroxide bath 5 is drained. Pipes and valves for drainage of the peroxide bath are not shown in the simplified sketches of FIGS. 1 and 2. By the drainage the seal between the inlet chamber 2 and the aseptic chamber 6 is removed. This means that the difference in pressure between the inlet chamber 2 and the aseptic chamber 6 will be levelled out. The result may be an overpressure in the inlet chamber 2 and the protection against peroxide emission to the environment is the lip seal 3 at the inlet of the packaging material web 1.

According to the present invention a safety chamber 12 is placed in front of the inlet for the packaging material web 1 into the inlet chamber 2. A lip seal 13 is placed at the inlet for the packaging material web 1 into the safety chamber 12. A suction pipe 14 opens into the safety chamber 12. Said suction pipe 14 is connected to the suction pipe 4 of the inlet chamber 2 by means of a check valve 15, controlling the pressure of the safety chamber 12. The check valve 15 is normally adjustable to control the pressure. By means of the suction pipe 14 it is possible to form an underpressure in the safety chamber 12. The packaging material web 1 will thus pass two lip seals 3, 13 and the safety chamber 12 before going into the inlet chamber 2.

By means of the suction pipe 14 the safety chamber 12 will be held at an underpressure both during stops and in normal production. As stated above, the peroxide bath 5 is drained during stops in the packaging machine. During stops the safety chamber 12 will still be held at an underpressure even if the inlet chamber 2 is held at an overpressure. Thus, any peroxide emissions passing the lip seal 3 of the inlet chamber 2 will be sucked out of the safety chamber 12 without passing to the environment. Any overpressure inside the inlet chamber 2 will act on the lip seal 3 of the inlet chamber 2 in a closing position. Thus, both in normal operation and during stops the lip seals 3, 13 of both the inlet chamber 2 and the safety chamber 12 will protect against peroxide emissions. The protection against peroxide emission given by the two lip seals 3, 13 are further supported by the underpressure in the inlet chamber 2 during normal production and the underpressure in the safety chamber 12 during stops.

Figure 3:
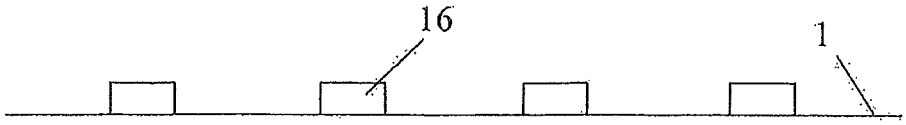
FIG. 3 is a side view of one example of a packaging material web passing through the sterilization part and the safety chamber of previous Figs.
Figure 4:
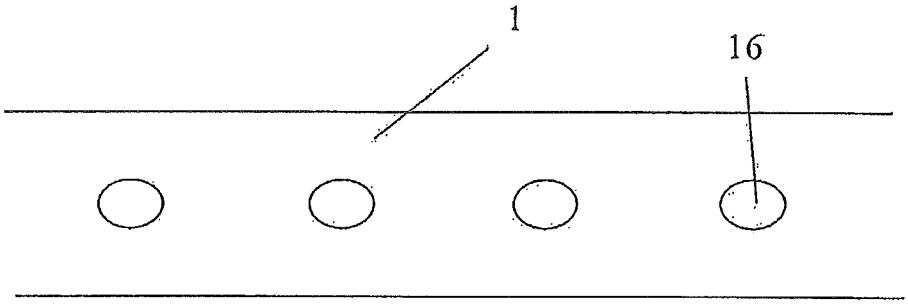
FIG. 4 is a plan view of the packaging material web of FIG. 3.

In the example shown in FIGS. 3 and 4 the packaging material web 1 has injection moulded elements such as necks or pouring spouts 16 which are parts of the closure of formed carton packages. Even though the packaging material web 1 is shown as having a number of necks or spouts, a person skilled in the art realizes that the invention can be used also with packaging material webs having no necks. At short stops or normal stops of the packaging machine there is a possibility that a neck 16 is placed in one of the lip seals 3, 13. If a neck 16 is placed in a lip seal 3, 13 that lip seal 3, 13 will possibly not be able to completely seal off the inlet of the packaging material web 1. There might be open parts adjacent the neck 16. If the neck 16 is placed at the lip seal 3 of the inlet chamber 2, the lip seal 13 of the safety chamber 12 and the underpressure of the safety chamber 12 will still eliminate any risk of peroxide emission to the environment. If the neck 16 is placed at the lip seal 13 of the safety chamber 12 the lip seal 3 of the inlet chamber 2 will eliminate any risk of peroxide emission. The safety chamber 12 is designed to have such a length that two necks 16 of the packaging material web 1 never can be at the lip seals 3, 13 of the inlet chamber 2 and safety chamber 12, respectively, at the same time.

If a packaging material web having no necks are used both lip seals 3, 13 and the underpressure of the safety chamber 12 will act against any peroxide emissions.

The invention claimed is:

1. A method of conveying a packaging material web in a packaging machine, which forms sealed packaging containers from the packaging material web, to sterilize the packaging material web, the method comprising:

conveying the packaging material web into a safety chamber while the safety chamber is in a first state of pressure lower than a pressure outside the packaging machine;

conveying the packaging material web, which has passed through the safety chamber, through a lip seal at an inlet of an inlet chamber while the inlet chamber is in a second state of pressure lower than the pressure outside the packaging machine;

conveying the packaging material web, which has passed through the inlet chamber, through a peroxide bath; and conveying the packaging material web, which has passed through the peroxide bath, through an aseptic chamber while the aseptic chamber is in a third state of pressure higher than the pressure outside the packaging machine.

2. The method of claim 1, wherein a suction pipe opens into the safety chamber, holding the safety chamber at the first state of pressure lower than the pressure outside the packaging machine.

3. The method of claim 2, wherein a check valve is placed in the suction pipe controlling the pressure of the safety chamber.

4. The method of claim 3, wherein the suction pipe opening into the safety chamber is connected to a main suction pipe.

5. The method of claim 2, wherein the suction pipe opening into the safety chamber is connected to a main suction pipe.

6. The method of claim 1, wherein the lip seal of the inlet chamber is a first lip seal, and the packaging material web goes into the safety chamber by way of a second lip seal.

7. The method of claim 6, wherein a suction pipe opens into the safety chamber, holding the safety chamber at the first state of pressure lower than the pressure outside the packaging machine.

8. The method of claim 1, wherein the lip seal is a first lip seal, and the packaging material web passes through a second lip seal at an inlet of the safety chamber before entering the safety chamber in the first state of pressure lower than the pressure outside the packaging machine.

9. The method of claim 8, further comprising draining the peroxide bath while maintaining the safety chamber in the first state of pressure lower than the pressure outside the packaging machine and while maintaining the aseptic chamber in the third state of pressure higher than the pressure outside the packaging machine.

10. The method of claim 1, wherein a size of the safety chamber is adapted to the packaging material web in such a way that necks or spouts on the packaging material web are not placed in the lip seal of the inlet chamber and a lip seal of the safety chamber at the same time.

11. The method of claim 1, further comprising draining the peroxide bath while maintaining the safety chamber in the first state of pressure lower than the pressure outside the packaging machine and while maintaining the aseptic chamber in the third state of pressure higher than the pressure outside the packaging machine.

* * * * *